US005620566A

United States Patent [19]

Holopainen

[11] Patent Number: 5,620,566

[45] Date of Patent: Apr. 15, 1997

[54] EXTENDED NIP PREPRESS FOR A PAPER WEB

[75] Inventor: Kari Holopainen, Jyväskylä , Finland

[73] Assignee: Valmet Corporation, Helsinki, Finland

[21] Appl. No.: 459,111

[22] Filed: Jun. 2, 1995

[30] Foreign Application Priority Data

Jun. 3, 1994 [FI] Finland ..... 942616

[51] Int. Cl.[6] ..... D21F 3/02

[52] U.S. Cl. ..... 162/205; 162/210; 162/358.3; 162/305

[58] Field of Search ..... 162/203, 205, 162/210, 358.3, 305

[56] References Cited

U.S. PATENT DOCUMENTS

| | | | |
|---|---|---|---|
| 3,853,698 | 12/1974 | Mohr | 162/358.3 |
| 4,556,454 | 12/1985 | Dahl et al. | 162/361 |
| 4,568,423 | 2/1986 | Laapotti | 162/358 |
| 4,570,314 | 2/1986 | Holik et al. | 162/358.3 |
| 4,917,768 | 4/1990 | Ilmarinen | 162/358.3 |
| 4,923,570 | 5/1990 | Steiner et al. | 162/358.3 |
| 4,976,820 | 12/1990 | Laapotti | 162/358.3 |
| 5,389,205 | 2/1995 | Pajula et al. | 162/358.3 |

FOREIGN PATENT DOCUMENTS

| | | |
|---|---|---|
| 70952 | 4/1984 | Finland . |
| 872632 | 12/1987 | Finland . |

*Primary Examiner*—Karen M. Hastings
*Attorney, Agent, or Firm*—Steinberg, Raskin & Davidson, P.C.

[57] ABSTRACT

A prepress for a paper web in a paper machine including a load shoe which is pressed against a backing element, preferably a vacuum roll, by a load pressure generating by a medium, preferably liquid, which at the same time acts as a lubrication medium in the prepress. The load shoe is in direct engagement with a water permeable wire upon which the paper web is supported.

20 Claims, 4 Drawing Sheets

EXTENDED NIP PREPRESS FOR A PAPER WEB

BACKGROUND OF THE INVENTION

The present invention relates to a prepress for paper web in which a web is carried between two wires and pressed to remove water therefrom. The present invention also relates to a method for lubricating a load shoe in a prepress and pressing the load shoe against a backing element situated in opposed relationship to the load shoe.

In the prior art, so-called prepress equipment is known in paper drying in which a separate load shoe is used to press the web running between wires, preferably in conjunction with a vacuum roll. The vacuum roll is a roll provided with a vacuum box in its interior whereby with the aid of a vacuum produced therein, water is drawn off from the web through perforation in the roll shell, and preferably also through separate circumferential grooving. A particular drawback in conventional prepress arrangements has been finding an appropriate operating system for the load shoe. Use of oil as the operating liquid in the operating system of the load shoe necessitates that the arrangement be well housed in order to prevent leakages of oil.

It is a problem in conventional prepress arrangements utilizing oil as the operating liquid that there is the potential for the oil to leak and contaminate lubricating medium applied to lubricate the load shoe of the prepress arrangement vis-a-vis the wire passing thereover and thus the web.

OBJECTS AND SUMMARY OF THE INVENTION

It is an object of the invention to provide a new and improved prepress arrangement in which the problem of leakage of an operating fluid contaminating the lubricating medium is eliminated.

It is another object of the invention to provide a new and improved method in a prepress arrangement in which a single fluid is used to both lubricate the load shoe and press the load shoe against a backing element situated in opposed relationship thereto.

In order to achieve these objects, and others, the present invention is directed to a novel type of load shoe of a prepress for paper web. In the invention, as the operating liquid of the load shoe, the same liquid used for lubrication of the shoe is used, i.e., there is only a single medium or liquid which is used both for lubrication and as the operating fluid of the load shoe. Preferably, the fluid used in the invention is water so that not only is the operating fluid and the lubricating fluid the same, but also it is the very same liquid which is being removed from the web. Therefore, the system can be open and there is no need to house and shelter it from the elements. Any spilled water is gathered in a gathering trough situated adjacent the shoe and is conducted back into circulation.

In the prepress in accordance with the invention, in the wire section the water removal is intensified by pressing the load shoe against the vacuum roll. The web is conducted between the press shoe and the vacuum roll preferably between two wires or felts, which herein are generally referred to as weaves. For the load liquid of the shoe press, water is used in a preferred embodiment of the invention. In this case, the water serves thus both as lubrication medium and as a medium producing simultaneous load pressure, i.e., the pressure medium. With the aid of water, the shoe is pressed against the back roll, the degree of pressing corresponding to the amount of pressure provided by the flow of water. The wire on the side of the shoe may be water-permeable, slightly water-permeable or water-impermeable.

In one embodiment of the invention, the water or other fluid is pumped from a container along pipes at load pressure into one or more loading chambers, whereby the pressure of the water exerts an effect on the load shoe, pressing it against a backing surface of the load shoe. The water acts at the same time as lubrication medium. From the pressure volume in conjunction with the load shoe, a passage is provided to the front surface of the load shoe and preferably to a groove on the front edge of the load shoe relative to the propagation direction of the web. The groove extends across substantially the entire width of the load shoe. As such, the lubrication medium, preferably water, is conducted to the front edge of the load shoe and a mobile felt transfers the lubrication medium in the form of a film to the surface of the load shoe. On the other side of the load shoe, the trailing side, the lubrication medium is gathered into a trough and conducted further back into water circulation.

In the method in accordance with the invention, a front surface of the load shoe in arranged in opposed relationship to the backing element, the load shoe is pressed against the backing element by means of pressure provided by a fluid medium, and the front surface of the load shoe is lubricated by directing the medium thereto. Thus, a single medium serves to load the load shoe and lubricate the front surface of the same. Further, a pair of wires carrying a web therebetween is directed into a nip defined between the load shoe and the backing element whereby the front surface of the load shoe engages with one of the wires. If the medium is water, the water removed in the nip from the wires and the web may be collected after the wires and web have passed through the nip, and recirculated to press the load shoe and lubricate the front surface thereof.

The invention is described below referring to certain preferred embodiments presented in the figures of the accompanying drawings. However, the invention is not intended to be exclusively restricted to the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
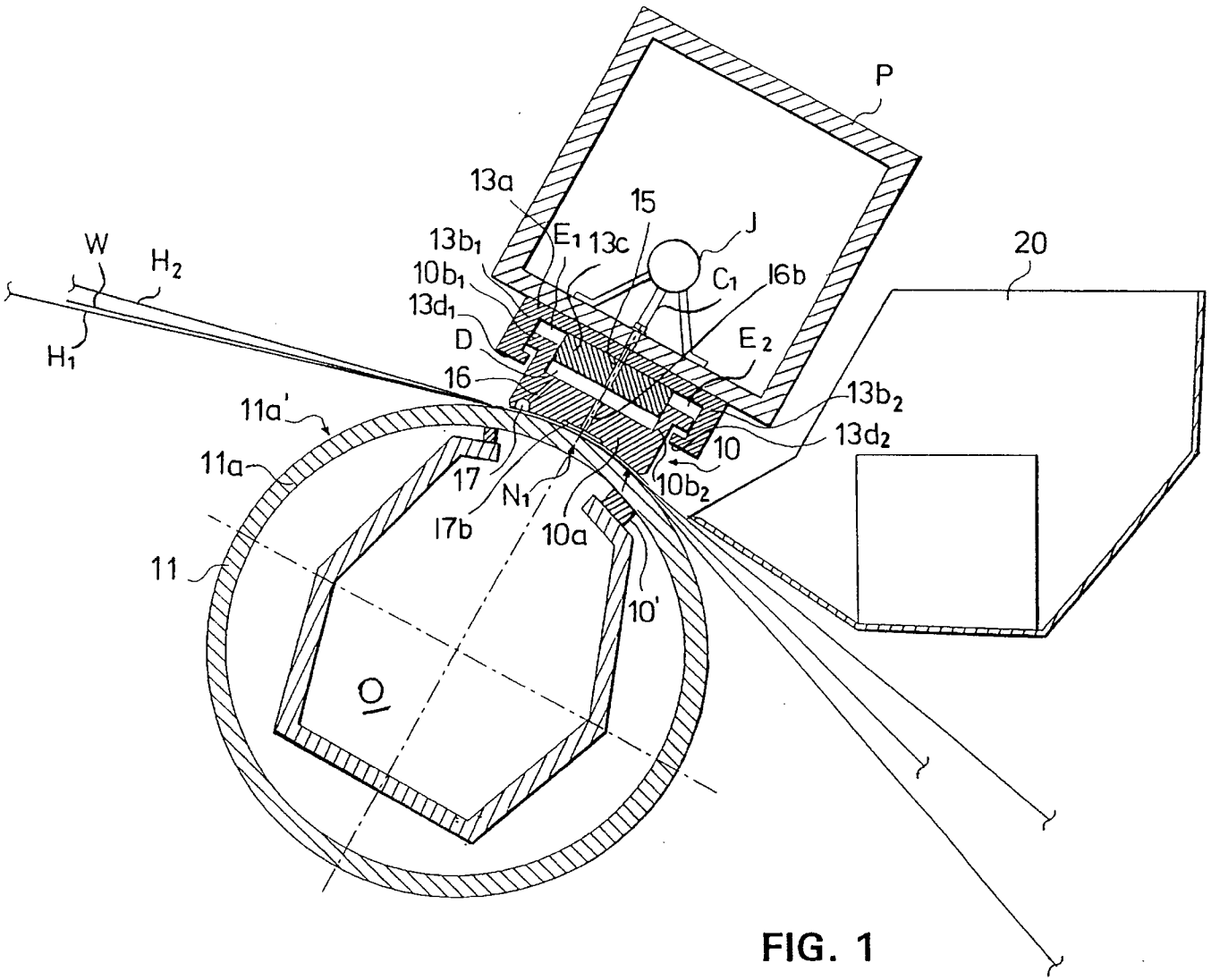
FIG. 1 shows a cross-sectional view of prepress in accordance with the invention.

Referring to the drawings wherein like reference numerals refer to the same or similar element, in the prepress shown in FIG. 1, a prepress nip $N_1$ is formed between a load shoe 10 and a back-up roll, preferably a vacuum roll 11. Wires/weaves $H_1$ and $H_2$ carry a web W therebetween and are conducted via nip $N_1$ from the left side in FIG. 1. Water removal occurs in nip $N_1$ into an internal vacuum space O in the vacuum roll 11 defined by chamber means. The vacuum or suction effect is intensified by pressing the load shoe 10 against an outer surface 11'a of a shell 11a of the vacuum roll 11. The load shoe has an outer or front surface 10' which substantially corresponds to the shape of the roll shell 11a. The load shoe 10 is movably connected to a seat 13. The load shoe 10 comprises a web plate part 10a and branch parts $\mathbf{10b_1}$, $\mathbf{10b_2}$ extending therefrom. The seat 13 comprises a web plate part 13a and branch parts $\mathbf{13b_1}$, $\mathbf{13b_2}$, and at ends of the branch parts, inwardly directed edges $\mathbf{13d_1}$, $\mathbf{13d_2}$. In the approximate center point of the web plate part 13a, a neck part 13c is attached so that spaces $E_1$ and $E_2$ are defined between the neck 13c and the side walls $\mathbf{13b_1}$, $\mathbf{13b_2}$. The side branches $\mathbf{10b_1}$, $\mathbf{10b_2}$ of load shoe 10 are disposed in a respective one of the spaces $E_1$, $E_2$.

A medium, preferably water, is conducted by pressure via channel 15 in neck 13c into a space defined between the neck 13c of the seat 13 and the load shoe 10 which is chamber D. The medium is passed or flows from the space D onward via a channel 16 in web plate part 10a into a groove 17 on the front surface 10' of the load shoe. The medium is liquid, preferably water or an aqueous mixture. The groove 17 is arranged to extend over substantially the entire length of the load shoe. Also, the medium may be passed to a longitudinally extending groove 17b in the front surface of the web plate part 10a through a channel 16b in a center region of the web plate part 10a to thereby lubricate a larger portion of the front surface of the web plate part 10a.

In space D, the pressure of the medium generates a force on the undersurface (rear surface) of the web plate part 10a of the load shoe 10, thereby pressing the load shoe 10 against its abutting surface, preferably against the outer surface 11a' of the shell 11a of the vacuum roll 11. The branch parts $\mathbf{10b_1}$, $\mathbf{10b_2}$ move in the spaces $E_1$, $E_2$, respectively, during movement of the web plate part 10a of the load shoe 10. Web W and the wires/weaves $H_1$ and $H_2$ pass via the surfaces, i.e., via the nip $N_1$ between the front surface 10' of the load shoe 10 and the outer surface 11'a of the shell 11a of the vacuum roll 11.

The medium, which is preferably water, is conducted via branch channels $C_1$, $C_2$, . . . of a manifold J arranged within a frame beam P and mounted thereto into channel 15 to be conducted into space D. Any spilled water and water leaving the load shoe are conducted into a trough 20 arranged after the frame beam P in a running direction of the wires/weaves and web and then back into water circulation.

The prepress shown in FIG. 1 comprises a vacuum roll 11 as a backing element. However, it is possible that another roll may be used instead of vacuum roll 11, such as a roll provided with a recessed surface.

Figure 2:
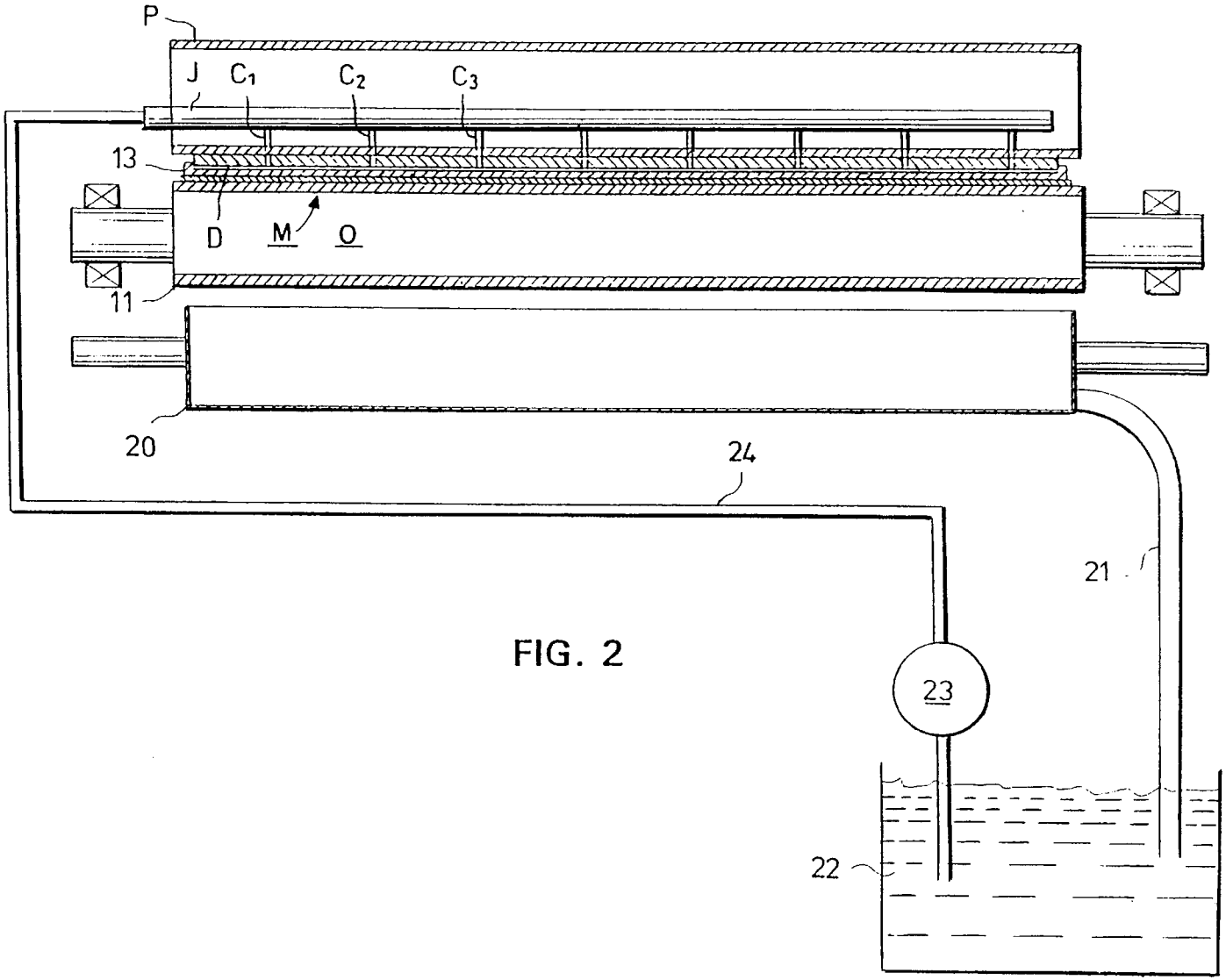
FIG. 2 shows the lubrication medium/load medium circulation arrangement of the prepress shown in FIG. 1 in the machine direction wherein the collector tank is shown in a position below the vacuum roll for illustration purposes only.

FIG. 2 shows a liquid circulation arrangement of a prepress in accordance with the invention. The medium is conducted via the branch channels $C_1$, $C_2$, . . . of the manifold J within the frame beam P to one or more chambers D between the rear surface of the load shoe 10 and the seat 13, and the load shoe 10 is pressed in line with the surfaces of the branch parts $\mathbf{13b_1}$, $\mathbf{13b_2}$ of the seat 13 towards the backing element 11, e.g., especially toward the vacuum roll 11. Any water discharged from the load shoe 10 with wire/weave $H_2$ is conducted into a collector tank 20 situated below the vacuum roll 11, from there along a channel 21 into a liquid container 22 and furthermore, is then pumped through a pump 23 along channel 24 back into the manifold J to be recirculated through the load shoe 10.

Figure 3:
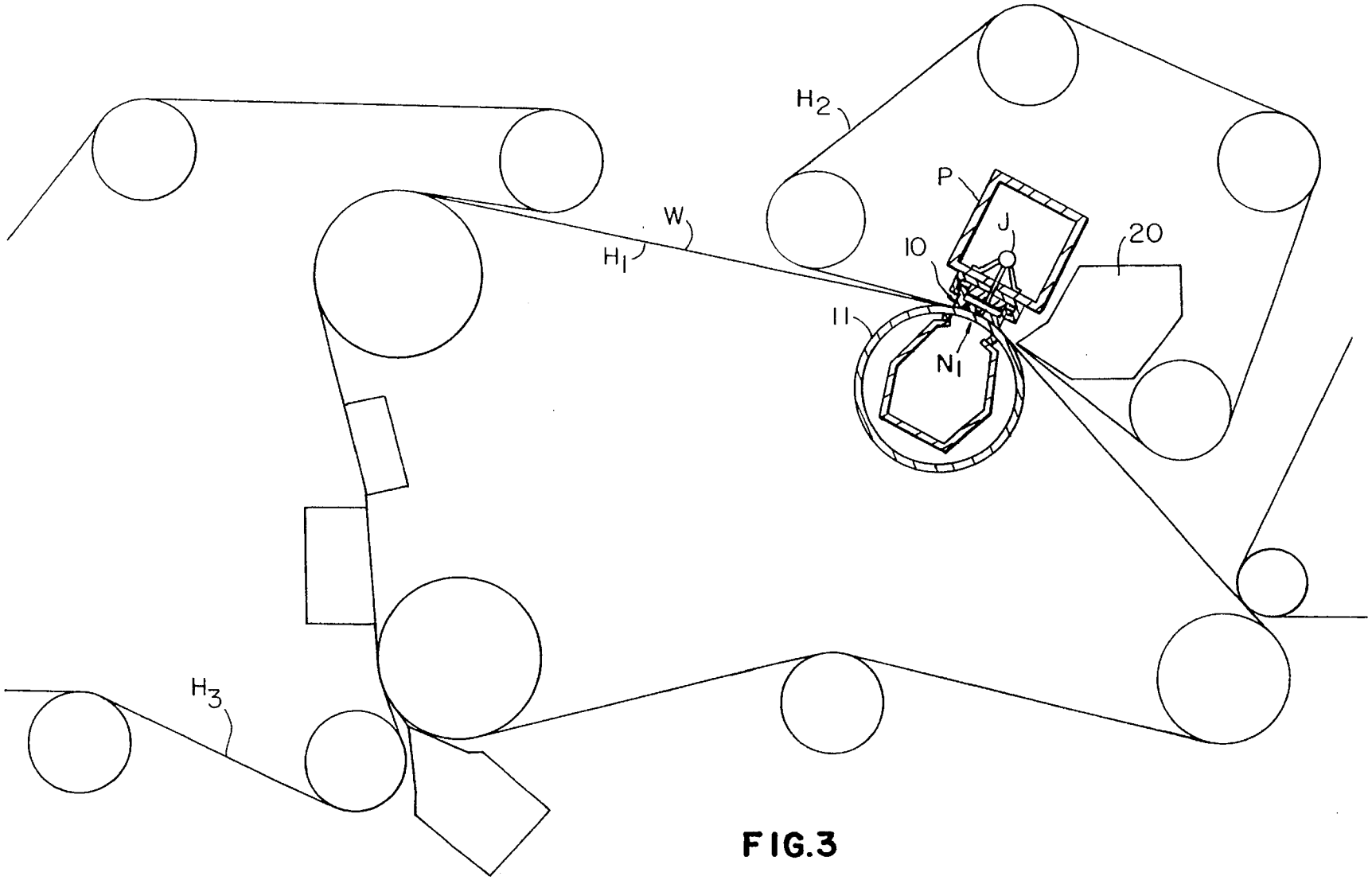
FIG. 3 shows the prepress in accordance with the invention in a more comprehensive context.

FIG. 3 shows an application of the prepress in accordance with the invention. Traveling of the web W is represented by arrows $L_1$ and the circulation directions of felt transfers with arrows $L_2$ and $L_3$. Web W is conducted from a felt circulation wire/weave $H_3$, at the point of separation after the forming section, and is transferred in line with wire/weave $H_1$ between wire/weave $H_1$ and wire/weave $H_2$, and into nip $N_1$. The water is gathered in trough 20 and moved back into manifold J. Thereafter, the web is carried on wire/weave $H_1$ to be transferred therefrom and carried further by additional wire, weaves or felts into the press section of the paper machine. Thus, in this embodiment, the prepress is arranged between the forming section and the press section of the paper machine.

Figure 4A:
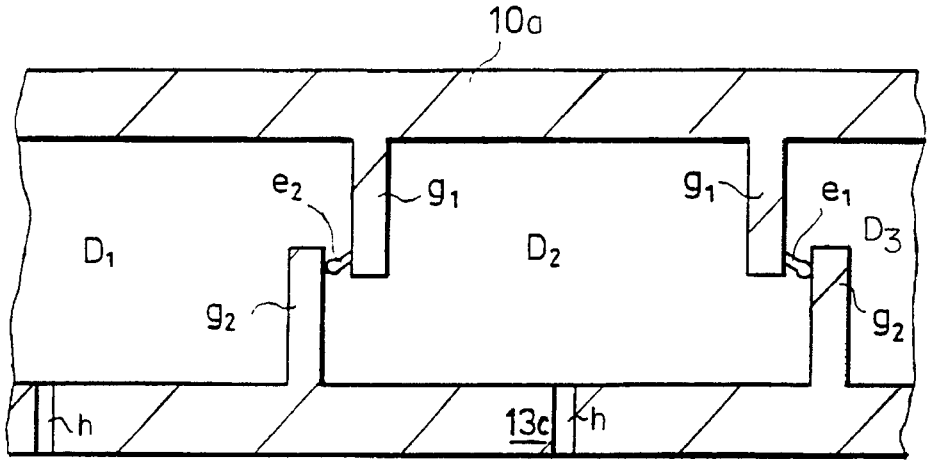
FIG. 4A shows a longitudinal, cross-sectional view of an embodiment of the invention taken along the line 4—4 in FIG. 1.
Figure 4B:
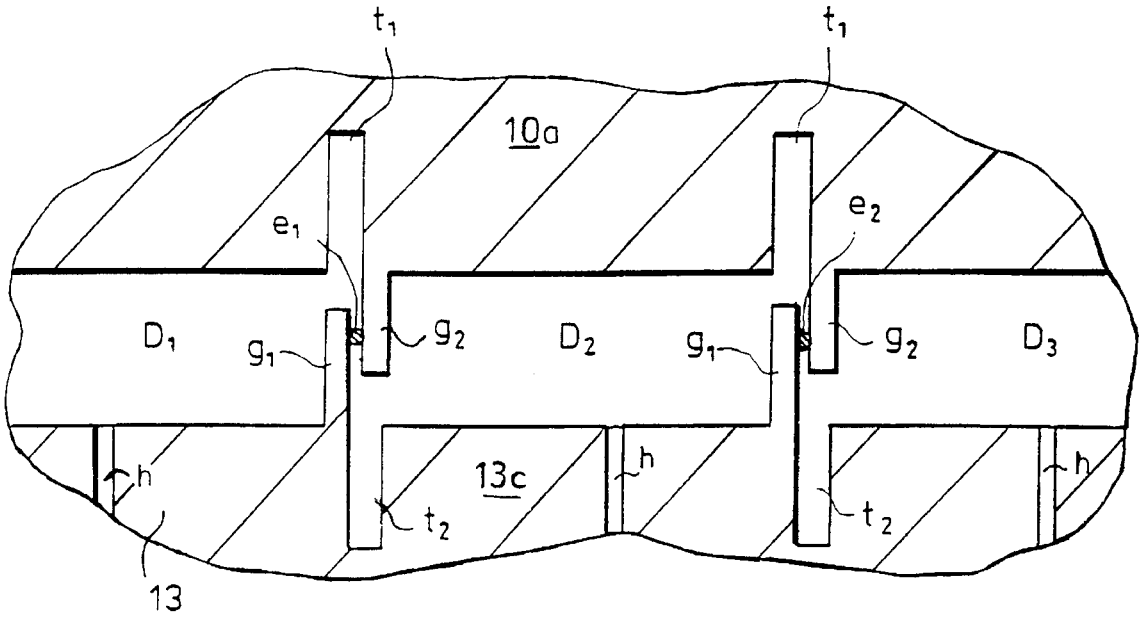
FIG. 4B shows a longitudinal, cross-sectional view of another embodiment of the invention taken along the line 4—4 in FIG. 1.

In the embodiment shown in FIGS. 4A and 4B are sectional view of different embodiments taken through the line 4—4 of FIG. 1. In these embodiments, there are a plurality of chambers $D_1$, $D_2$, $D_3$, . . . between the neck portion 13c and the web plate part 10a. A dedicated channel h leads to each of the chambers $D_1$, $D_2$, $D_3$, . . . . As shown in FIG. 4A, the neck portion 13c has projections $g_2$ and the rear surface of the web plate part 10a also has projections $g_1$. Between projections $g_1$ and $g_2$, sealing structures $e_1$, $e_2$ are provided to seal the chambers. As shown in FIG. 4B, the neck portion 13c has projections $g_1$ and recesses $t_2$ and the rear surface of the web plate part 10a also has projections $g_2$ and recesses $t_1$. Between projections $g_1$ and $g_2$, sealing structures $e_1$, $e_2$ are provided to seal the chambers. In this manner, by directing variable amounts of the pressure medium to the chambers, e.g., by appropriate regulation of the flow of the medium from the manifold J, it is possible to adjust the loading pressure provided by the load shoe along the width of the shoe, e.g., to profile the moisture content of the paper web at different positions of width. Also, in these embodiments, the web plate part 10a of the load shoe 10 may be made of a flexible material such as plastic.

The examples provided above are not meant to be exclusive. Many other variations of the present invention would be obvious to those skilled in the art, and are contemplated to be within the scope of the appended claims.

I claim:

1. A press for pressing a paper web as the web is supported in direct engagement with a water permeable first wire, comprising a load shoe arranged in a loop of the first wire, said load shoe having a front surface in direct engagement with the first wire, a backing element situated in opposed relationship to a front surface of said load shoe, first means for directing a fluid pressure medium to press said load shoe toward said backing element, and second means for directing said pressure medium onto said front surface of said load shoe to lubricate said front surface of said load shoe.

2. The press of claim 1, wherein said first means comprise a chamber defined in part by said load shoe, said second means comprising a groove situated at a front edge of said front surface of said load shoe proximate to said backing element, and a channel in said load shoe connecting said chamber and said groove, said pressure medium being conducted from said chamber via said channel to said groove.

3. The press of claim 1, further comprising a seat arranged adjacent to said load shoe, said load shoe comprising a web plate part, said first means comprising a chamber defined between said seat and a rear surface of said web plate part of said load shoe.

4. The press of claim 3, wherein said load shoe further comprises branch parts extending from said web plate part, said seat comprising a neck portion and a pair of side walls spaced from said neck portion to define spaces therebetween, each of said branch parts being situated and movable within one of said spaces.

5. The press of claim 4, further comprising a channel arranged in said neck portion, said pressure medium being directed through said channel into said chamber.

6. The press of claim 2, wherein said groove extends substantially over the entire length of said load shoe in the cross-machine direction.

7. The press of claim 1, wherein said first means comprise a chamber defined in part by said load shoe, further comprising a trough arranged at in an area of a trailing side of said load shoe, the trailing side of said load shoe being defined as the side from which the first wire exits from a nip formed between said load shoe and said backing element, said trough receiving water carried by the first wire from the nip, a frame beam to which said load shoe is movably mounted, at least one branch channel arranged in connection with said frame beam for supplying said pressure medium to press said load shoe, and a water circulation arrangement connected to said trough and receiving water therefrom, said water circulation arrangement directing water to said chamber communicating with the load shoe, said water circulation arrangement comprising pump means for pumping said pressure medium.

8. The press of claim 1, wherein said pressure medium is water or an aqueous mixture.

9. The press of claim 1, wherein said backing element is a vacuum roll comprising means defining a vacuum chamber.

10. The press of claim 1, wherein said front surface of said load shoe is in nip-defining relationship with said backing element.

11. The press of claim 1, further comprising a seat arranged adjacent to said load shoe, said load shoe comprising a web plate part, said first means comprising a plurality of individual chambers defined between said seat and a rear surface of said web plate part of said load shoe.

12. The press of claim 11, further comprising a plurality of channels arranged in said neck portion, one of said channels connecting to a respective one of said chambers, and a manifold for distributing said pressure medium to said plurality of channels.

13. The press of claim 11, wherein said plurality of individual chambers are defined by projections on a rear surface of said web plate part and projections on a front surface of said neck portion.

14. The press of claim 4, wherein said seat further comprises an inwardly directed portion connected to each of said branch parts to substantially close said spaces such that said branch parts are limited in movement within said spaces.

15. The press of claim 1, wherein the press is situated between a forming section and a press section of a paper machine, the web being in direct engagement with a second wire such that the web is supported by and between said first and second wires between said load shoe and said backing element.

16. A press for pressing a paper web situated between a forming section and a press section of a paper machine, the press including a load shoe and a backing element situated in opposed relationship to a front surface of said load shoe, the web being supported in direct engagement with a water permeable first wire, said load shoe being arranged in a loop of the first wire, the improvement comprising said front surface of said load shoe being arranged in direct engagement with the first wire, first means for directing a fluid pressure medium to press said load shoe toward said backing element, and second means for directing said pressure medium onto said front surface of said load shoe to lubricate said front surface of said load shoe.

17. The press of claim 16, wherein said first means comprise a chamber defined in part by said load shoe, said second means comprising a groove situated at a front edge of said front surface of said load shoe proximate to said backing element, and a channel in said load shoe connecting said chamber and said groove, said pressure medium being conducted from said chamber via said channel to said groove.

18. The press of claim 16, further comprising a seat arranged adjacent to said load shoe, said load shoe comprising a web plate part, said means comprising a chamber defined between said seat and a rear surface of said web plate part of said load shoe.

19. A method for pressing a paper web, comprising the steps of:

supporting the web in direct engagement with a water permeable first wire, arranging a load shoe in a loop of the first wire such that a front surface of said load shoe is in direct engagement with the first wire and in opposed relationship to a backing element, pressing said load shoe toward said backing element by means of pressure provided by a fluid medium, and lubricating said front surface of said load shoe by directing the fluid medium thereto.

20. The method of claim 19, wherein the fluid medium is water, further comprising the steps of:

forming a nip between said load shoe and said backing element, collecting water removed in the nip from the first wire and the web in a trough after the first wire and web have passed through the nip, and recirculating the water from the trough to press said load shoe and lubricate said front surface of said load shoe.

* * * * *